United States Patent [19]

Yoshida et al.

[11] Patent Number: 4,639,416

[45] Date of Patent: Jan. 27, 1987

[54] INTERNAL LATENT IMAGE-TYPE SILVER HALIDE EMULSION

[75] Inventors: Tetsuo Yoshida; Tadayoshi Kokubo, both of Kanagawa, Japan

[73] Assignee: Fuji Photo Film Co., Ltd., Kanagawa, Japan

[21] Appl. No.: 609,176

[22] Filed: May 11, 1984

[30] Foreign Application Priority Data

May 12, 1983 [JP] Japan ..... 58-83222

[51] Int. Cl.[4] ..... G03C 1/28

[52] U.S. Cl. ..... 430/567; 430/568; 430/940; 430/409; 430/603; 430/604; 430/605

[58] Field of Search ..... 430/567, 568, 940, 409, 430/604, 605, 603, 599

[56] References Cited

U.S. PATENT DOCUMENTS 3,317,322 5/1967 Porter et al. ..... 430/567
3,761,276 9/1973 Evans ..... 430/567
4,035,185 7/1977 Evans et al. ..... 430/567
4,431,731 2/1984 Sugimoto et al. ..... 430/940
4,444,865 4/1984 Silverman et al. ..... 430/567

*Primary Examiner*—Won H. Louie
*Attorney, Agent, or Firm*—Sughrue, Mion, Zinn, Macpeak, and Seas

[57] ABSTRACT

An internal latent image-type silver halide emulsion containing core/shell type silver halide grains with a mean grain size of about 0.4 μm or less, the grains comprising a core of chemically sensitized silver halide and a shell of silver halide covering at least the light-sensitive sites of the core and the surface of the grains being chemically sensitized wherein the core is chemically sensitized to such an extent that the difference between fog density $F_1$ and fog density $F_2$ as defined herein (i.e., internal fog density) is at least 0.10. This emulsion permits the formation of good reversal images in which $D_{max}$ is high and $D_{min}$ is low and, furthermore, has a superior storage stability.

11 Claims, No Drawings

INTERNAL LATENT IMAGE-TYPE SILVER HALIDE EMULSION

FIELD OF THE INVENTION

The present invention relates to an internal latent image-type silver halide emulsion forming a direct positive photographic image. More particularly, it is concerned with an internal latent image-type silver halide emulsion containing silver halide grains with a mean grain size of not more than 0.4 μm, forming a direct positive photographic image in which $D_{max}$ is high and $D_{min}$ is low.

BACKGROUND OF THE INVENTION

U.S. Pat. Nos. 3,317,322 and 3,761,276 disclose that when chemical sensitization is applied to the surface of internal latent image-type silver halide grains comprising a core of silver halide doped with metal ions, or chemically sensitized, or subjected to both treatments, and a shell of the silver halide covering at least light-sensitive sites of the core (hereinafter referred to as "core/shell type grains"), a reversal image is obtained by development in the presence of foggants, or by a direct reversal process of the type that an overall light-exposure is applied at the time of development.

These core/shell type grains, the core of silver halide being at least chemically sensitized, when employed in a fine grain silver halide emulsion with a mean grain size of not more than 0.4 μm in order to obtain a direct positive photographic material which provides good graininess and high resolution power have the disadvantages that only a reversal image in which $D_{max}$ is low and $D_{min}$ is high is obtained, and that the light-sensitive material has insufficient stability with time.

That is, even if an internal latent image-type silver halide emulsion is prepared by applying chemical sensitization to the core of silver halide grains with a mean grain size of not more than 0.4 μm to the extent that when applied to the core of silver halide grains with a relatively large grain size (e.g., more than 0.4 μm) (for example, to the extent applied in preparation method of Emulsion A at Example 1 in U.S. Pat. No. 3,761,276) or applying chemical sensitization to the core of silver halide grains with a mean grain size of not more than 0.4 μm to such an extent that addition amount of chemical sensitizer is increased in proportion to the increase of specific surface area of the core of silver halide grains (i.e., in proportion to becoming small in the core of silver halide grains) and then applying chemical sensitization to the shell of silver halide grains, a satisfactory reversal image cannot be obtained, a satisfactory image cannot be formed; $D_{max}$ is low or $D_{min}$ is high and good reversal performance cannot be obtained.

SUMMARY OF THE INVENTION

An object of the invention is to provide an internal latent image-type emulsion which even if the mean grain size of the silver halide grains is not more than 0.4 μm, can produce a satisfactory reversal image in which $D_{max}$ is high and $D_{min}$ is low.

Another object of the invention is to provide an internal latent image-type silver halide emulsion having satisfactory stability with time.

The present invention provides an internal latent image-type silver halide emulsion containing core/shell type silver halide grains with a mean grain size of about 0.4 μm or less, the grains comprising a core of chemically sensitized silver halide and a shell of silver halide covering at least the light-sensitive sites of the core, and the surface of the grains being chemically sensitized, wherein the core is chemically sensitized to such an extent that the difference between fog density $F_1$ and fog density $F_2$ as defined below is at least 0.10, where fog density $F_1$ is the fog density when the internal latent image-type emulsion is coated in an amount (as silver) of 1.5 g/m$^2$ and developed with Developer D as described below at 20° C. for 13 minutes without application of imagewise exposure (not including base density).

Fog density $F_2$ is the fog density when the internal latent image-type emulsion is coated in an amount (as silver) of 1.5 g/m$^2$ and developed with Developer E as described below at 20° C. for 13 minutes without application of imagewise exposure (not including base density).

| | |
|---|---|
| Composition of Developer D | |
| N—Methyl-p-aminophenol Sulfate | 2.5 g |
| L-Ascorbic Acid | 10 g |
| Sodium Metaborate | 35 g |
| Potassium Bromide | 1 g |
| Sodium Thiosulfate | 3 g |
| Water to make | 1,000 ml |
| Composition of Developer E | |
| N—Methyl-p-aminophenol Sulfate | 2.5 g |
| L-Ascorbic Acid | 10 g |
| Sodium Metaborate | 35 g |
| Potassium Bromide | 1 g |
| Water to make | 1,000 ml |

That is, it has been found that the objects are attained by carrying out chemical sensitization of the core to such an extent that the difference between $F_1$ (total fog of the negative image) and $F_2$ (surface fog of the negative image), i.e., $F_1$–$F_2$ (internal fog of the negative image), is at least 0.10.

DETAILED DESCRIPTION OF THE INVENTION

It has been unexpected according to the present invention that in core/shell type silver halide grains comprising a core of silver halide chemically sensitized and a shell covering at least the light-sensitive sites of the core, the surface of the grains being chemically sensitized, the degree of chemical sensitization necessary for obtaining good reversal performance remarkably must be varied depending upon the size of silver halide grains and in fine grain core/shell type silver halide grains with a mean grain size of not more than 0.4 μm, when according to the above described processing conditions the chemical sensitization is strongly applied to the core of silver halide grains to the extent that internal fog of the negative image ($F_1$–$F_2$) is at least 0.10, a good reversal image can be obtained. That is because when chemical sensitization is strongly applied to a core/shell type silver halide emulsion with a relatively large grain size to the extent that internal fog of the negative image ($F_1$–$F_2$) is at least 0.10 according to the present invention $D_{max}$ is low and reversal performance is deteriorated good reversal image can be obtained.

Although the exact reason why the degree of chemical sensitization for core of core/shell type silver halide grains with a fine grain size must be strengthened is not clear, while not desiring to be bound it is believed to be due to the fact that the light-sensitive site of inner portion and surface of the grains are in physically close relation to each other and, therefore, are difficultly distinguished from each other. For this reason, these fine silver halide grains cannot become good core/shell internal latent image-type silver halide grains.

In the present invention, core/shell type silver halide grains having a mean grain size of 0.05 to 0.4 μm are used. More specifically, those grains having a mean grain size of about 0.1 to 0.3 μm are effectively used.

The term "mean grain size" as used herein indicates the mean of the grain diameters when silver halide grains are spherical or nearly spherical, or the edge lengths when they are cubic, calculated based on projected areas.

In preparing core/shell type silver halide grains to be used in the emulsion of the present invention, the core of the silver halide which is chemically sensitized or is subjected to both treatments of chemical sensitization and doping with metal ions is first formed, and then the surface of the core is covered with the shell of silver halide, which is further chemically sensitized. It is not necessary for the entire surface of the grains constituting the core to be covered with the shell. It is sufficient if at least the light-sensitive sites (where chemical sensitization is made or light-decomposed silver is formed upon light exposure) of the core are covered with the shell. It is determined with degree of internal fog of the negative image evaluated in the method described above whether light-sensitive sites of the core are sufficiently covered with the shell.

The chemical sensitization of the core of the core/shell type silver halide grains can be performed using known techniques such as the methods described in Grafkides, *Chimie et Physique Photographique,* Paul Montel Co. (1967), V. L. Zelikman et al., *Making and Coating Photographic Emulsions,* The Focal Press Co. (1964), and H. Frieser ed., *Die Grundlagen der Photographischen Prozesse mit Silberhalogeniden,* Akademische Verlagsgesellschaft (1968).

That is, a sulfur sensitization method using compounds containing sulfur capable of reacting with silver ion, or using active gelatin, a reduction sensitization method using reducing substances, a noble metal sensitization method using noble metal (e.g., gold) compounds, and so forth can be used alone or in combination with each other. Of these methods, a combination of the gold sensitization method and the sulfur sensitization method provides the best results. In some cases, the reduction sensitization method may be used in combination with the gold sensitization method and the sulfur sensitization method.

Sulfur sensitizers which can be used include thiosulfates, thioureas, thiazoles, and rhodanines. Representative examples are described in U.S. Pat. Nos. 1,574,944, 2,410,689, 2,278,947, 2,728,668 and 3,656,955. Reduction sensitizers which can be used include stannous salts, amines, hydrazine compounds, formamidinesulfinic acid, and silane compounds. Representative examples are described in U.S. Pat. Nos. 2,487,850, 2,419,974, 2,518,698, 2,983,609, 2,983,610 and 2,694,637. For noble metal sensitization, gold complex salts and complex salts of metals belonging to Group VIII of the Periodic Table such as platinum, iridium and palladium can be used. Representative examples are described in U.S. Pat. Nos. 2,399,083, 2,448,060 and British Pat. No. 618,061.

In order to strengthen the degree of chemical sensitization, it is effective that an addition amount of chemical sensitizer is increased, the chemical sensitization is applied at high temperature for a long time and conditions such as pH, pAg or etc. are controlled. It is generally known that fog is increased as the degree of chemical sensitization is strengthened and fog formed due to chemical sensitization of core of core/shell type silver halide grains can be shown as internal fog ($F_1$–$F_2$) in the case of processing the core/shell type silver halide grains under the condition as described above. The object of the present invention can be achieved when the degree of chemical sensitization of core is strengthened and the internal fog ($F_1$–$F_2$) is at least 0.10.

Conditions under which the chemical sensitization is performed can be determined appropriately. In general, preferred results are obtained when the chemical sensitization is conducted under conditions so that the pH is 9 or less, the pAg is 10 or less, and the temperature is 40° C. or higher. In some cases, however, conditions not falling within the above-defined ranges may be employed.

The core may be doped with metal ions simultaneously with the chemical sensitization. For this doping of the core with metal ions, a method in which a metal ion source, such as cadmium salts, zinc salts, lead salts, thallium salts, iridium salts or its complex salts, rhodium salts or its complex salts, and iron salts or its complex salts, is present during the formation of silver halide grains constituting the core or physical ripening can be used. Metal ions are usually used in a proportion of at least $10^{-6}$ mol per mol of silver halide.

The above-described treatment of the silver halide of the core and a technique to cover the surface of silver halide grains constituting the core with silver halide constituting the shell are known. For example, the methods described in U.S. Pat. Nos. 3,206,316, 3,317,322, 3,367,778 (excluding a step of fogging the surface of grains), and 3,761,276 can be employed advantageously.

The ratio of the amount of silver halide used in the core to the amount of silver halide used in the shell is not critical and can be determined appropriately. Usually the amount in the shell is employed in a proportion of from 2 to 10 mols per mol of the amount in the core.

The silver halide of the core and that of the shell preferably have the same composition, but they may have different compositions. Suitable silver halides which can be used herein include silver bromide, silver iodide, silver chloride, silver chlorobromide, silver bromoiodide, silver chlorobromoiodide, etc. The silver halide emulsion of the present invention is preferably composed of at least 50 mol% of silver bromide. Most preferred is a silver bromoiodide emulsion, especially containing about 10 mol% or less of silver iodide.

These core/shell type silver halide grains may have a regular crystal form such as a cubic or octahedral form, or may have an irregular crystal form such as a spherical form and a tabular form or a composite form thereof. Furthermore, a mixture of grains having different crystal forms may be used.

In the present invention, the core is chemically sensitized so that the internal fog density of the negative image as determined under the above-described conditions is at least 0.10 and preferably at least 0.15. If, however, the chemical sensitization is performed to an excessive extent, problems such as a reduction in sensitivity arise. Thus, it is preferred for the chemical sensitization to be performed to the necessary extent. Although this upper limit varies depending on the halogen composition and so forth and cannot be set forth unequivocally, the chemical sensitization is preferably carried out so that the internal fog density of the negative image as determined under the above-described conditions is not more than 0.50.

The surface of the core/shell type silver halide grains as prepared above is then chemically sensitized. For this chemical sensitization, the methods described for the chemical sensitization of the core can be employed. The chemical sensitization of the core/shell type silver halide grain surface is performed to such an extent that the characteristics as an internal latent image type emulsion are not degraded. The term "characteristics as an internal latent image type emulsion" is used herein to mean that the maximum density of a light-sensitive material, the material comprising a transparent support and a given emulsion coated thereon, when exposed to light for a predetermined time of from 0.01 to 10 seconds and developed with Developer A (an internal type developer) as described below at 20° C. for 3 minutes (the density is determined by the usual photographic density measuring method) is at least 5 times greater than that of the same material as described above when exposed to light in the same manner as above and developed with Developer B (a surface type developer) also as described below at 20° C. for 4 minutes.

| | |
|---|---|
| Developer A | |
| Hydroquinone | 15 g |
| Monomethyl-p-aminophenol Sesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1,000 ml |
| Developer B | |
| p-Oxyphenolglycine | 10 g |
| Sodium Carbonate | 100 g |
| Water to make | 1,000 ml |

The core/shell type silver halide grains are dispersed in a binder.

Gelatin can be used advantageously as a binder. Other hydrophilic colloids can also be used. Examples of suitable hydrophilic colloids are proteins such as gelatin derivatives, graft polymers of gelatin and other polymers, albumin and casein, cellulose derivatives such as hydroxyethyl cellulose, carboxymethyl cellulose and cellulose sulfuric acid esters, and sugar derivatives such as sodium alginate and starch derivatives.

Lime-processed gelatin, acid-processed gelatin and enzyme-processed gelatin as described in *Bull. Soc. Sci. Photo., Japan,* No. 16, page 30 (1966) can be used as the gelatin. In addition, hydrolyzates and enzyme decomposition products of gelatin can be used.

The internal latent image-type silver halide emulsion of the present invention may be spectrally sensitized with methine dyes and so forth. Dyes which can be used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine, merocyanine and complex merocyanine dyes. In these dyes, any of the nuclei commonly used as hetrocyclic nuclei is cyanine dyes can be employed. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; nuclei resulting from the fusion of alicyclic hydrocarbon rings to the foregoing nuclei; and nuclei resulting from the fusion of aromatic hydrocarbon rings to the foregoing nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus can be employed. These nuclei may contain substitutents on the carbon atom thereof.

The merocyanine or complex merocyanine dyes may contain nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodamine nucleus, and a thiobarbituric acid nucleus.

Useful sensitizing dyes are described in, for example, West German Pat. No. 929,080, U.S. Pat. Nos. 2,231,658, 2,493,748, 2,503,776, 2,519,001, 2,912,329, 3,655,394, 3,656,959, 3,672,897, 3,694,217, British Pat. No. 1,242,588 and Japanese Patent Publication No. 14030/69.

These sensitizing dyes can be used alone or as a combination with each other. Combinations of sensitizing dyes are often used for the purpose of supersensitization. Typical examples of such combinations are described in, for example, U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609, 3,837,862, British Pat. No. 1,344,281, and Japanese Patent Publication No. 4936/68.

In preparing a light-sensitive material using the internal latent image-type silver halide emulsion of the present invention, the emulsion is coated on a support together with other photographic layers. The amount of the emulsion coated is not critical in the present invention. Usually, when the emulsion is coated in an amount such that the amount of silver is from about 40 to about 800 mg per square feet of the support, a desirable reversal image can be obtained.

Suitable supports are those as described in *Research Disclosure,* Vol. 176, RD-17643, clause XVII (1978).

The internal latent image-type silver halide photographic emulsion of the present invention may contain compounds such as polyalkylene oxides or the ether, ester, amine or like derivatives thereof, thioether compounds, thiomorpholines, quaternary ammonium salts, urethane derivatives, urea derivatives, imidazole derivatives and 3-pyrazolidones for the purpose of increase in sensitivity and in contrast or of acceleration in development. For example, the compounds described in U.S. Pat. Nos. 2,400,532, 2,423,549, 2,716,062, 3,617,280, 3,772,021, and 3,808,003 can be used.

The internal latent image-type silver halide photographic emulsion of the present invention may contain antifoggants and stabilizers. For example, the compounds as described in *Research Disclosure,* Vol. 176, RD-17643 (1978), clause VI can be used.

The internal latent image-type silver halide photographic emulsion of the present invention may contain developing agents. For example, the developing agents as described in *Research Disclosure,* Vol. 176, RD-17643 (1978), clause XX can be used.

The internal latent image-type silver halide photographic emulsion of the present invention can be dispersed in colloids hardenable with various organic or inorganic hardeners. For example, the hardeners as described in *Research Disclosure,* Vol. 176, RD-17643 (1978), Section X can be used.

The internal latent image-type silver halide photographic emulsion of the present invention may contain coating aids. Those compounds as described in *Research Disclosure,* Vol. 176, RD-17643 (1978), Section XI can be used as these coating aids.

The internal latent image-type silver halide photographic emulsion of the present invention may contain the so-called color couplers. Those compounds as described in *Research Disclosure,* Vol. 176, RD-17643 (1978), clause VII can be used as these color couplers.

The internal latent image-type silver halide photographic emulsion of the present invention may further contain additives such as antistatic agents, plasticizers, matting agents, lubricants, ultraviolet absorbers, brightening agents, and anti-air oxidants.

Dyes may be incorporated into the photographic emulsion layers and other hydrophilic colloid layers of the light-sensitive materials prepared using the internal latent image-type silver halide photographic emulsion of the present invention as filter dyes or for various purposes such as prevention of irradiation. For example, the dyes as described in *Research Disclosure,* Vol. 176, RD-17643 (1978), clause VIII can be used.

The internal latent image-type silver halide photographic emulsion of the present invention is developed in the presence of fogging agents (nucleating agents) or with an overall exposure to light. Typical examples of fogging agents which can be used include hydrazines as described in U.S. Pat. Nos. 2,588,982 and 2,563,785; hydrazines and hydrazones as described in U.S. Pat. No. 3,277,552; acylhydrazines as described in British Pat. No. 2,089,057; quaternary salt compounds as described in U.S. Pat. No. 1,283,835, Japanese Patent Publication No. 38164/74, U.S. Pat. Nos. 3,615,615, 3,719,494, 3,734,738, 4,094,683 and 4,115,122; sensitizing dyes containing a nucleating substituent as described in U.S. Pat. No. 3,718,470; and acylhydrazinophenylthiourea compounds as described in U.S. Pat. Nos. 4,030,925 and 4,031,127. In addition, the compounds as described in U.S. Pat. No. 4,139,387 and Japanese Patent Application (OPI) Nos. 133126/79 and 74729/79 can be used (the term "OPI" as used herein refers to a "published unexamined Japanese patent application").

It is desirable for the fogging agent to be employed in an amount such that the resulting internal latent image-type silver halide emulsion, when developed with a surface developer, provides a maximum density which is sufficiently satisfactory. Preferably the fogging agent is incorporated into the photographic emulsion layers or their adjacent layers.

The internal latent image-type silver halide photographic emulsion of the present invention can be used in various applications. In particular, it is useful as an emulsion for direct positive photographic light-sensitive materials, as an emulsion for multilayer reversal color light-sensitive materials, and as an emulsion for use in the color diffusion transfer process of multilayer light-sensitive materials.

The internal latent image-type silver halide photographic emulsion of the present invention can be used in combination with diffusion transfer color image-providing substances releasing a diffusible dye as development progresses, so that after a suitable developing treatment the desired transferred image can be obtained in an image-receiving layer. A number of diffusion transfer dye image-providing substances are known. For example, the compounds as described in U.S. Pat. Nos. 3,227,551, 3,227,554, 3,443,939, 3,443,940, 3,658,524, 3,698,897, 3,725,062, 3,728,113, 3,751,406, 3,929,760, 3,931,144, 3,932,381, 3,928,312, 4,013,633, 3,932,380, 3,954,476, 3,942,987, 4,013,635, U.S. Pat. No. 351,673, British Pat. Nos. 840,731, 904,364, 1,038,331, West German Patent Application (OLS) Nos. 1,930,215, 2,214,381, 2,228,361, 2,317,134, 2,402,900 French Pat. No. 2,284,140, Japanese Patent Application (OPI) Nos. 113624/76 (corresponding to U.S. Pat. No. 4,055,428), 104343/76, 149328/78 and 143323/78 can be used. It is preferred to use dye image-providing substances of the type that is originally non-diffusible but undergoes cleavage after a redox reaction with the oxidized product of a developing agent, releasing a diffusible dye. These compounds are hereinafter referred to as "DRR compounds".

Various known developing agents can be used for developing light-sensitive materials prepared using the emulsion of the present invention. For example, polyhydroxybenzenes such as hydroquinone, 2-chlorohydroquinone, 2-methylhydroquinone, catechol, and pyrogallol; aminophenols such as p-aminophenol, N-methyl-p-aminophenol, and 2,4-diaminophenol; 3-pyrazolidones such as 1-phenyl-3-pyrazolidones, 1-phenyl-4,4-dimethyl-3-pyrazolidone, 1-phenyl-4-methyl-4-hydroxymethyl-3-pyrazolidone, and 5,5-dimethyl-1-phenyl-3-pyrazolidone; and ascorbic acids can be used alone or in combination with each other. More specifically, for example, the developers described in Japanese Patent Application (OPI) No. 55928/83 can be used.

In forming dye images in the presence of dye-forming couplers, aromatic primary amine developing agents, preferably p-phenylenediamine-based developing agents, can be used. Typical examples are 4-amino-3-methyl-N,N-diethylaniline hydrochloride, N,N-diethyl-p-phenylenediamine, 3-methyl-4-amino-N-ethyl-N-β-(methanesulfoamido)ethylaniline, 3-methyl-4-amino-N-ethyl-N-(β-sulfoethyl)aniline, 3-ethoxy-4-amino-N-ethyl-N-(β-sulfoethyl)aniline, and 4-amino-N-ethyl-N-(β-hydroxyethyl)aniline. These developing agents may be incorporated into an alkaline processing composition (processing element) or into a suitable layer of the light-sensitive element.

Where DRR compounds are used, if they are cross-oxidizable, any silver halide developers can be used.

The developer may contain compounds such as sodium sulfite, potassium sulfite, ascorbic acid and reductones (e.g., piperidinohexose reductone) as preservatives.

A direct positive image can be obtained by developing the light-sensitive material of the present invention with surface developers. These surface developers are such that the process of development is induced substantially by latent images or fog nuclei present on the surface of the silver halide grains. Although it is preferred for the developer not to contain silver halide solvents, it may contain silver halide solvents (e.g., sulfites) as long as the internal latent image does not substantially contribute until the development with the surface development centers of silver halide grains is complete.

The developer may contain compounds such as sodium hydroxide, potassium hydroxide, sodium carbonate, potassium carbonate, trisodium phosphate, and sodium metaborate as alkalis or buffers. These agents are employed in an amount so as to control the pH of the developer within the range of from 10 to 13 and preferably from 11 to 12.5.

The developer may contain color development accelerators such as benzyl alcohol. In order to further lower the minimum density of the direct positive image, it is advantageous for the developer to contain compounds commonly used as antifoggants, such as benzimidazoles (e.g., 5-nitrobenzimidazole), and benzotriazoles (e.g., benzotriazole and 5-methylbenzotriazole).

The light-sensitive material of the present invention can be processed with viscous developers. A viscous developer is a liquid composition containing the components necessary for developing the silver halide emulsion and for forming the diffusion transfer dye image. The solvent is composed mainly of water and sometimes contains hydrophilic solvents such as methanol and methyl Cellosolve. The processing composition contains a sufficient amount of alkali to maintain the pH necessary for causing development of the emulsion layer and further to neutralize acids (e.g., hydrohalic acids such as hydrobromic acid, and carboxylic acids such as acetic acid) formed during the steps of development and color image formation. Alkalis which can be used include alkali metal or alkaline earth metal salts, such as lithium hydroxide, sodium hydroxide, potassium hydroxide, a calcium hydroxide dispersion, tetramethyl ammonium hydroxide, sodium carbonate, trisodium phosphate, and the like, and amines such as diethylamine. Preferably sodium hydroxide is employed in a concentration such that the pH at room temperature is at least about 12 and particularly 14 or more.

When the light-sensitive material of the present invention is used in the diffusion transfer photographic process, it is preferably in the form of a film unit. This film unit, which is designed so that a light-sensitive element is processed by passing through a pair of pressure applying members arranged in a parallel relationship, is basically composed of the following three elements:

(1) A light-sensitive element containing an antifoggant;

(2) An image-receiving element: and (3) A processing element containing a means to release an alkaline processing composition in the film unit, such as a rupturable container, and further containing a silver halide developer.

The present invention is described in greater detail by reference to the following examples, but the present invention is not limited to the examples. Unless otherwise indicated, all parts, percents, ratios and the like are by weight.

EXAMPLE 1

The following emulsions were prepared.

Emulsions A-1 to A-18

An aqueous solution of potassium bromide and an aqueous solution of silver nitrate were added simultaneously to an aqueous gelatin solution at 40° C. over a 20 minute period with vigorous agitation to prepare a silver bromide emulsion with a mean grain size of 0.08 μm. This emulsion was divided into five equal portions. To each portion were added sodium thiosulfate and chloroauric acid (tetrahydrate) in the amounts shown in Table 1 below, and the resulting mixture was heated at 75° C. for 80 minutes to achieve chemical sensitization (chemical sensitization of the grain core). With the thus-obtained silver bromide grains as the core, silver bromide was allowed to grow under the same conditions as described above, and finally a core/shell type silver bromide emulsion with a mean grain size of 0.18 μm was obtained. This emulsion was further divided into three equal portions. To each portion were added sodium thiosulfate and chloroauric acid (tetrahydrate) in the amounts shown in Table 1 below, and the resulting mixture was chemically sensitized by heating at 65° C. for 60 minutes (surface chemical sensitization) to prepare an internal latent image-type silver halide emulsion. In this way, Emulsions A-1 to A-18 were prepared.

TABLE 1

| | Grain Core Chemical Sensitization(1) | | Grain Surface Chemical Sensitization(2) | |
|---|---|---|---|---|
| Emulsion | Sodium Thiosulfate | Chloroauric Acid | Sodium Thiosulfate | Chloroauric Acid |
| A-1 | 20 | 20 | 0 | 0 |
| 2 | 20 | 20 | 2.0 | 2.0 |
| 3 | 20 | 20 | 6.2 | 6.2 |
| 4 | 20 | 20 | 12.4 | 12.4 |
| 5 | 40 | 40 | 2.0 | 2.0 |
| 6 | 40 | 40 | 6.2 | 6.2 |
| 7 | 40 | 40 | 12.4 | 12.4 |
| 8 | 130 | 130 | 2.0 | 2.0 |
| 9 | 130 | 130 | 6.2 | 6.2 |
| 10 | 130 | 130 | 12.4 | 12.4 |
| 11 | 580 | 580 | 2.0 | 2.0 |
| 12 | 580 | 580 | 6.2 | 6.2 |
| 13 | 580 | 580 | 12.4 | 12.4 |
| 14 | 860 | 860 | 2.0 | 2.0 |
| 15 | 860 | 860 | 6.2 | 6.2 |
| 16 | 860 | 860 | 12.4 | 12.4 |
| 17 | 130 | 130 | 24.8 | 24.8 |
| 18 | 580 | 580 | 24.8 | 24.8 |

(1)mg/core Ag/mol
(2)mg/core/shell Ag/mol

Emulsions B-1 to B-3

An aqueous solution of potassium bromide and an aqueous solution of silver nitrate were added simultaneously to an aqueous gelatin solution to prepare a silver bromide emulsion with a mean grain size of 0.25 μm. This emulsion was divided into two equal portions. To each portion was added sodium thiosulfate and chloroauric acid (tetrahydrate) in the amounts shown in Table 2 below, and the resulting mixture was heated at 75° C. for 80 minutes to achieve chemical sensitization (chemical sensitization of core). With the thus-obtained silver bromide grains as the core, silver bromide was allowed to grow under the same conditions as described above, and finally a core/shell type silver bromide emulsion with a mean grain size of 0.4 μm was prepared. This emulsion was further divided into two equal portions. To each portion were added sodium thiosulfate and chloroauric acid (tetrahydrate) in the amounts shown in Table 2 below, and the resulting mixture was chemically sensitized by heating at 65° C. for 60 minutes (surface chemical sensitization) to prepare an internal latent image-type silver halide emulsion. In this way, Emulsions B-1 to B-3 were prepared.

TABLE 2

| | Grain Core Chemical Sensitization(1) | | Grain Surface Chemical Sensitization(2) | |
|---|---|---|---|---|
| Emulsion | Sodium Thiosulfate | Chloroauric Acid | Sodium Thiosulfate | Chloroauric Acid |
| B-1 | 7 | 7 | 0.7 | 0.7 |
| B-2 | 7 | 7 | 2.1 | 2.1 |
| B-3 | 190 | 190 | 0.7 | 0.7 |

(1)mg/core Ag/mol
(2)mg/core/shell Ag/mol

Emulsions C-1 to C-4 (Control Group)

An aqueous solution of potassium bromide and an aqueous solution of silver nitrate were added simultaneously to an aqueous gelatin solution at 75° C. over a 40 minute period with vigorous agitation to prepare a silver bromide emulsion with a mean grain size of 0.4 μm. This emulsion was divided into two equal portions. To each portion were added sodium thiosulfate and chloroauric acid (tetrahydrate) in the amounts shown in Table 3 below, and the resulting mixture was heated at 75° C. for 80 minutes to achieve chemical sensitization (chemical sensitization of core). With the thus-obtained silver bromide grains as the core, silver bromide was allowed to grow under the same conditions as described above, and finally a core/shell type silver bromide emulsion with a mean grain size of 0.6 μm was prepared. This emulsion was further divided into two equal portions. To each portion were added sodium thiosulfate and chloroauric acid (tetrahydrate) in the amounts shown in Table 3 below, and the resulting mixture was heated at 65° C. for 60 minutes to achieve chemical sensitization (surface chemical sensitization), whereupon an internal latent image-type silver halide emulsion was obtained. In this way, Emulsions C-1 to C-4 were prepared.

TABLE 3

| | Grain Core Chemical Sensitization(1) | | Grain Surface Chemical Sensitization(2) | |
|---|---|---|---|---|
| Emulsion | Sodium Thiosulfate | Chloroauric Acid | Sodium Thiosulfate | Chloroauric Acid |
| C-1 | 4 | 4 | 0.5 | 0.5 |
| C-2 | 4 | 4 | 1.5 | 1.5 |
| C-3 | 150 | 150 | 0.5 | 0.5 |
| C-4 | 200 | 200 | 0.5 | 0.5 |

(1)mg/core Ag/mol
(2)mg/core/shell Ag/mol

To each emulsion was added a fogging agent, anhydro-2-[3-(phenylhydrazo)butyl]-3-(3-sulfopropyl)benzothiazolium hydroxide, in an amount of 1,000 mg per mol of silver. The resulting emulsion was coated on a polyethylene terephthalate support in an amount (as silver) of 1,500 mg/m$^2$ and a gelatin protective layer was further coated thereon to prepare a light-sensitive sample. Two samples were prepared for each emulsion.

Each sample was exposed for 1 second through a step wedge to a 1 kw tungsten lamp at a color temperature of 2,854° K. One of the two samples for each emulsion was developed with Developer C having the formulation shown in Table 4 at 37° C. for 1 minute and then stopped, fixed and rinsed in the usual manner to obtain a positive image.

The other sample was developed with Developer D or Developer E having the formulation shown in Table 5 below at 20° C. for 13 minutes and then stopped, fixed and rinsed in the usual manner to obtain a negative image. The solutions used for the stops and the fixations as described above are as follows.

Stop Solution

Aqueous Acetic Acid Solution

| Fixing Solution | |
|---|---|
| $H_2O$ | 600 ml |
| Ammonium Thiosulfate (70%) | 320 ml |
| $Na_2SO_3$ | 20 g |
| KI | 0.5 g |
| $CH_3COOH$ (90%) | 3 ml |

-continued

| Fixing Solution | |
|---|---|
| $H_2O$ to make | 1 l |

The total fog, surface fog and internal fog (difference between the total fog and surface fog) of the negative image were measured. The results obtained are shown in Table 6 below.

TABLE 4

| Developer C | |
|---|---|
| Hydroquinone | 35 g |
| Sodium Sulfite | 80 g |
| Potassium Carbonate | 40 g |
| Sodium Bromide | 3 g |
| 1-Phenyl-4-methyl-4-hydroxymethyl-3-pyrazolidone | 3 g |
| 5-Methylbenzotriazole | 20 mg |
| Water to make | 1,000 ml |
| The pH was adjusted to 11.6 with potassium hydroxide | |

TABLE 5

| | |
|---|---|
| Developer D | |
| N—Methyl-p-aminophenol Sulfate | 2.5 g |
| L-Ascorbic Acid | 10 g |
| Sodium Metaborate | 35 g |
| Potassium Bromide | 1 g |
| Sodium Thiosulfate | 3 g |
| Water to make | 1,000 ml |
| Developer E | |
| N—Methyl-p-aminophenol Sulfate | 2.5 g |
| L-Ascorbic Acid | 10 g |
| Sodium Metaborate | 35 g |
| Potassium Borate | 1 g |
| Water to make | 1,000 ml |

Table 6 shows $D_{max}$, $D_{min}$ and $D_{max}/D_{min}$ of the positive image formed in each sample prepared using Emulsions A-1 to A-18, and the total fog, surface fog, and internal fog (not including base density) of the negative image.

TABLE 6

| | Positive Image | | | Negative Image | | |
|---|---|---|---|---|---|---|
| Emulsion | $D_{max}$ | $D_{min}$ | $D_{max}/D_{min}$ | Total Fog | Surface Fog | Internal Fog |
| A-1 | No reversion occurred | | | 0.01 | 0.01 | 0 |
| A-2 | " | | | 0.01 | 0.01 | 0 |
| A-3 | " | | | 0.01 | 0.01 | 0 |
| A-4 | " | | | 0.01 | 0.01 | 0 |
| A-5 | 1.40 | 0.17 | 8.2 | 0.02 | 0.01 | 0.01 |
| A-6 | 2.30 | 0.40 | 5.8 | 0.01 | 0.01 | 0 |
| A-7 | 2.52 | 0.75 | 3.4 | 0.03 | 0.01 | 0.02 |
| A-8 | 1.46 | 0.15 | 9.7 | 0.07 | 0.01 | 0.06 |
| A-9 | 2.60 | 0.35 | 7.4 | 0.06 | 0.01 | 0.05 |
| A-10 | 2.60 | 0.55 | 4.7 | 0.06 | 0.02 | 0.04 |
| A-11 | 1.50 | 0.06 | 25.0 | 0.12 | 0.01 | 0.11 |
| A-12 | 2.50 | 0.06 | 41.7 | 0.13 | 0.01 | 0.12 |
| A-13 | 2.50 | 0.08 | 31.3 | 0.14 | 0.01 | 0.13 |
| A-14 | 1.60 | 0.06 | 26.7 | 0.18 | 0.01 | 0.17 |
| A-15 | 2.45 | 0.06 | 40.8 | 0.20 | 0.01 | 0.19 |
| A-16 | 2.45 | 0.06 | 40.8 | 0.19 | 0.02 | 0.17 |
| A-17 | 2.60 | 1.00 | 2.6 | 0.11 | 0.04 | 0.07 |
| A-18 | 2.50 | 0.12 | 20.8 | 0.16 | 0.04 | 0.12 |

By comparing the results in Table 1 with those in Table 6, it can be seen that when the internal fog value of the negative image is adjusted to 0.10 or more (A-11 to A-16 and A-18), a good reversion image is obtained and the $D_{max}/D_{min}$ ratio is markedly increased.

The $D_{max}$, $D_{min}$ and $D_{max}/D_{min}$ of the positive image and the total fog, surface fog and internal fog (not including base density) of the negative image were measured of samples prepared using Emulsions B-1 to B-3 and E-1 to E-4. The results obtained are shown in Table 7 below.

TABLE 7

| | Positive Image | | | Negative Image | | |
|---|---|---|---|---|---|---|
| Emulsion | $D_{max}$ | $D_{min}$ | $D_{max}/D_{min}$ | Total Fog | Surface Fog | Internal Fog |
| B-1 | 1.00 | 0.05 | 20.0 | 0.01 | 0.01 | 0 |
| B-2 | 1.32 | 0.25 | 5.28 | 0.01 | 0.01 | 0 |
| B-3 | 1.02 | 0.04 | 25.5 | 0.11 | 0.01 | 0.10 |
| C-1 | 1.15 | 0.04 | 28.8 | 0.01 | 0.01 | 0 |
| C-2 | 1.22 | 0.09 | 13.6 | 0.01 | 0.01 | 0 |
| C-3 | 0.88 | 0.06 | 14.7 | 0.10 | 0.01 | 0.09 |
| C-4 | 0.70 | 0.05 | 14.0 | 0.15 | 0.02 | 0.13 |

By comparing the results in Table 6 with those in Table 7, the following conclusions can be drawn.

In emulsions having the usual mean grain size (i.e., 0.4μ or more), if the degree of chemical sensitization of the core is increased, the quality of the reversal image is reduced and the $D_{max}/D_{min}$ ratio decreases.

In contrast, in Emulsions A and B having a mean grain size as fine as 0.4μ or less, if the core is chemically sensitized to an extent such that the internal fog value of the negative image is in excess of 0.10 (A-11 to A-16 and A-18, and B-3), a good reversal image is obtained and the $D_{max}/D_{min}$ ratio is greatly increased.

EXAMPLE 2

Emulsions D-1 and D-2 were prepared in the same manner as in the preparation of Emulsions A-1 to A-18 except that 5-benzylidene-3-methyl rhodanine and chloroauric acid (tetrahydrate) were used in place of sodium thiosulfate and chloroauric acid (tetrahydrate) in the amounts shown in Table 8 below in the chemical sensitization of the core.

TABLE 8

| | Grain Core Chemical Sensitization(1) | | Grain Surface Chemical Sensitization(2) | |
|---|---|---|---|---|
| Emulsion | 5-Benzylidene-3-methyl Rhodanine | Chloroauric Acid | Sodium Thio-sulfate | Chloroauric Acid |
| D-1 | 14.0 | 40 | 12.4 | 12.4 |
| D-2 | 200 | 580 | 12.4 | 12.4 |

(1)mg/core Ag/mol
(2)mg/core/shell Ag/mol

Light-sensitive samples were prepared, exposed and developed in the same manner as described in Example 1 using Emulsions D-1 and D-2 and then $D_{max}$, $D_{min}$ and $D_{max}/D_{min}$ of the positive image and the total fog, surface fog and internal fog of the negative image were measured. The results obtained are shown in Table 9 below.

TABLE 9

| | Positive Image | | | Negative Image | | |
|---|---|---|---|---|---|---|
| Emulsion | $D_{max}$ | $D_{min}$ | $D_{max}/D_{min}$ | Total Fog | Surface Fog | Internal Fog |
| D-1 | 2.30 | 0.65 | 3.5 | 0.04 | 0.01 | 0.03 |
| D-2 | 2.55 | 0.08 | 31.9 | 0.15 | 0.01 | 0.14 |

As is apparent from the results shown in Table 9 above, in a sample using Emulsion D-2 of the present invention in which the internal fog of the negative image is adjusted to at least 0.10, a good reversal image is obtained and the $D_{max}/D_{min}$ ratio is markedly increased.

While the invention has been described in detail and with reference to specific embodiments thereof, it will be apparent to one skilled in the art that various changes and modifications can be made therein without departing from the spirit and scope thereof.

What is claimed is:

1. An internal latent image silver halide emulsion containing core/shell silver halide grains with a mean grain size of about 0.4 μm or less, said grains comprising a core of chemically sensitized silver halide and a shell of silver halide covering at least the light-sensitive sites of the core, and the surface of said grains being chemically sensitized, wherein the core is chemically sensitized to such an extent that the difference between fog density $F_1$ and fog density $F_2$ as defined below is at least 0.10, where fog density $F_1$ is the fog density when the internal latent image emulsion is coated in an amount (as silver) of 1.5 g/m² and developed with Developer D as described below at 20° C. for 13 minutes without application of imagewise exposure, not including base density;

| Composition of Developer D | |
|---|---|
| N—Methyl-p-aminophenol Sulfate | 2.5 g |
| L—Ascorbic Acid | 10 g |
| Sodium Metaborate | 35 g |
| Potassium Bromide | 1 g |
| Sodium Thiosulfate | 3 g |
| Water to make | 1,000 ml |

and fog density $F_2$ is the fog density when the internal latent image emulsion is coated in an amount (as silver) of 1.5 g/m² and developed with Developer E as described below at 20° C. for 13 minutes without application of imagewise exposure, not including base density

| Composition of Developer E | |
|---|---|
| N—Methyl-p-aminophenol Sulfate | 2.5 g |
| L—Ascoribc Acid | 10 g |
| Sodium Metaborate | 35 g |
| Potassium Bromide | 1 g |
| Water to make | 1,000 ml |

2. The silver halide emulsion of claim 1, wherein said silver halide of the core and of the shell is chemically sensitized using sulfur sensitization, reduction sensitization, noble metal sensitization or a combination of such.

3. The silver halide emulsion of claim 1, wherein the chemically sensitized silver halide of the core and of the shell is sensitized using a combination of gold sensitization and sulfur sensitization.

4. The silver halide emulsion of claim 1, wherein the chemically sensitized silver halide of the core and of the shell is sensitized at a pH of 9 or less, a pAg of 10 or less and at a temperature of 40° C. or less.

5. The silver halide emulsion of claim 1, wherein the core of chemically sensitized silver halide is doped with one or more metal ions selected from the group consisting of cadmium ions, zinc ions, thallium ions, iridium ions, iridium complex ions, rhodium ions, rhodium complex ions, iron ions or iron complex ions, in an amount of at least $10^{-6}$ mol per mol of silver halide.

6. The silver halide emulsion of claim 1, wherein said silver halide is silver bromide, silver iodide, silver chloride, silver chlorobromide, silver bromoiodide or silver chlorobromoiodide.

7. The silver halide emulsion of claim 1, wherein said silver halide comprises at least 50 mol% of silver bromide and about 10 mol% or less of silver iodide.

8. The silver halide emulsion of claim 1, wherein the difference between fog density $F_1$ and fog density $F_2$ is at least 0.15 and not more than 0.50.

9. The silver halide emulsion of claim 1, wherein the core/shell silver halide grains have a mean grain size of about 0.05 to 0.4 μm.

10. The silver halide emulsion of claim 9, wherein the core/shell silver halide grains have a mean grain size of about 0.1 to 0.3 μm.

11. A photographic light-sensitive element comprising a support having thereon at least one layer containing the internal latent image silver halide emulsion of claim 1.

* * * * *